US010787719B2

(12) United States Patent
Fukumoto

(10) Patent No.: US 10,787,719 B2
(45) **Date of Patent: *Sep. 29, 2020**

(54) HIGH-SPEED TOOL STEEL, MATERIAL FOR TOOLS, AND METHOD FOR PRODUCING MATERIAL FOR TOOLS

(71) Applicant: Hitachi Metals, Ltd., Tokyo (JP)

(72) Inventor: Shiho Fukumoto, Shimane (JP)

(73) Assignee: Hitachi Metals, Ltd., Tokyo (JP)

( * ) Notice: Subject to any disclaimer, the term of this patent is extended or adjusted under 35 U.S.C. 154(b) by 177 days.

This patent is subject to a terminal disclaimer.

(21) Appl. No.: 15/781,704

(22) PCT Filed: Sep. 29, 2016

(86) PCT No.: PCT/JP2016/078954

§ 371 (c)(1),
(2) Date: Jun. 6, 2018

(87) PCT Pub. No.: WO2017/104220

PCT Pub. Date: Jun. 22, 2017

(65) Prior Publication Data

US 2018/0363080 A1 Dec. 20, 2018

(30) Foreign Application Priority Data

Dec. 17, 2015 (JP) ..... 2015-245953

(51) Int. Cl.
*C21D 6/02* (2006.01)
*C21D 8/00* (2006.01)
(Continued)

(52) U.S. Cl.
CPC ..... *C21D 8/005* (2013.01); *C21D 6/002* (2013.01); *C21D 6/005* (2013.01); *C21D 6/007* (2013.01);
(Continued)

(58) Field of Classification Search
CPC ..... C21D 6/002; C21D 6/007; C21D 6/02; C21D 8/005; C21D 9/22; C21D 9/24;
(Continued)

(56) References Cited

U.S. PATENT DOCUMENTS 6,272,963 B1 * 8/2001 Fukumoto ..... B23D 61/127 420/101
2014/0079585 A1 3/2014 Fukumoto
2018/0147636 A1 * 5/2018 Fukumoto ..... B23B 51/00

FOREIGN PATENT DOCUMENTS

CN 1262339 8/2000
CN 103667932 3/2014
(Continued)

OTHER PUBLICATIONS

"International Search Report (Form PCT/ISA/210)" of PCT/JP2016/078954, dated Dec. 20, 2016, with English translation thereof, pp. 1-3.

(Continued)

*Primary Examiner* — Jie Yang
(74) *Attorney, Agent, or Firm* — JCIPRNET

(57) ABSTRACT

Provided are a high-speed tool steel having excellent hot workability, and excellent damage resistance when made into various tools; a material for tools, and a method for producing the same. The high-speed tool steel contains, in mass %, 0.9-1.2% of C, 0.1-1.0% of Si, 1.0% or less of Mn, 3.0-5.0% of Cr, 2.1-3.5% of W, 9.0-10.0% of Mo, 0.9-1.2% of V, 5.0-10.0% of Co, 0.020% or less of N, and the remainder being Fe and impurities, wherein an M value calculated by a formula satisfies −1.5≤M value≤1.5. Formula: M value=−9.500+9.334[% C]−0.275[% Si]−0.566[% W]−0.404[% Mo]+3.980[% V]+0.166[% Co], where the characters in brackets [ ] indicate the contained amounts (mass %) of the respective elements. The present invention
(Continued)

also pertains to: a material for tools, which is obtained by using the high-speed tool steel; and a method for producing the material for tools.

5 Claims, 2 Drawing Sheets

(51) Int. Cl.

| | |
|---|---|
| ***C22C 38/30*** | (2006.01) |
| ***C22C 38/00*** | (2006.01) |
| ***C21D 9/24*** | (2006.01) |
| ***C21D 9/22*** | (2006.01) |
| ***C21D 6/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.
CPC ..... *C21D 6/008* (2013.01); *C21D 6/02* (2013.01); *C21D 9/22* (2013.01); *C21D 9/24* (2013.01); *C22C 38/00* (2013.01); *C22C 38/001* (2013.01); *C22C 38/002* (2013.01); *C22C 38/02* (2013.01); *C22C 38/04* (2013.01); *C22C 38/22* (2013.01); *C22C 38/24* (2013.01); *C22C 38/30* (2013.01)

(58) Field of Classification Search
CPC ..... C22C 38/00; C22C 38/22; C22C 38/24; C22C 38/30
USPC ..... 148/334
See application file for complete search history.

(56) References Cited

FOREIGN PATENT DOCUMENTS

| | | |
|---|---|---|
| CN | 103695789 | 4/2014 |
| EP | 1024208 | 8/2000 |
| EP | 2223763 | 9/2010 |
| GB | 2370844 | 7/2002 |
| JP | S5453614 | 4/1979 |
| JP | S579622 | 2/1982 |
| JP | S61015143 | 4/1986 |
| JP | H04180540 | 6/1992 |
| JP | H093604 | 1/1997 |
| JP | H0941091 | 2/1997 |
| JP | H0966305 | 3/1997 |
| JP | 2000144333 | 5/2000 |
| JP | 2000219935 | 8/2000 |
| JP | 2010280022 | 12/2010 |
| JP | 2014208870 | 11/2014 |

OTHER PUBLICATIONS

"Search Report of Europe Counterpart Application," dated Jul. 2, 2019, p. 1-p. 9.

* cited by examiner

HIGH-SPEED TOOL STEEL, MATERIAL FOR TOOLS, AND METHOD FOR PRODUCING MATERIAL FOR TOOLS

CROSS-REFERENCE TO RELATED APPLICATION

This application is a 371 application of the international PCT application serial no. PCT/JP2016/078954, filed on Sep. 29, 2016, which claims the priority benefit of Japan application no. 2015-245953, filed on Dec. 17, 2015. The entirety of each of the above-mentioned patent applications is hereby incorporated by reference herein and made a part of this specification.

TECHNICAL FIELD

The present invention relates to a high-speed tool steel, a material for tools using the same, and a method for producing the material for tools.

BACKGROUND ART

Conventionally, a cutting tool represented by a saw blade such as a band saw, a circular saw or the like is used for cutting a metal material such as a steel material. The saw blade is generally manufactured by the following process. First, molten steel adjusted to have a predetermined component composition is cast to prepare a material such as a steel ingot, a steel piece or the like, or powder obtained by an atomizing method or the like from the molten steel is processed by hot high-pressure molding to obtain a material, and this material is subjected to hot processing and then subjected to a variety of processing and heat treatments to produce a "cutting edge material" having a form such as a flat wire. Additionally, the cutting edge material is welded to a body material by electron beam welding, laser welding or the like, subjected to blade cutting work, quenched and tempered, and then finished into a saw blade as a final product.

Furthermore, plastic working tools represented by a mold or the like are conventionally used for plastic working of a metal material such as a steel material. These plastic working tools are also manufactured from "plastic working tool materials" obtained by hot-working the above-described material. Additionally, in general, a plastic working tool is manufactured by machining a plastic working tool material into shapes of various tools, performing quenching and tempering and then, if necessary, performing finishing work of machining or surface treatment.

SKH59 high-speed tool steel which is a JIS standard steel type (corresponding to M42 which is an AISI standard steel type) has been widely applied as a material for "material for tools" such as the material for cutting edge and the material for plastic working tool. SKH59 is a material which has excellent red heat hardness and durability at the time of cutting or plastic working and also has excellent characteristics as a material for the above-described material for tools. For example, Patent Document 1 discloses a band saw blade which employs SKH59 as a material for a cutting edge material, and a manufacturing method thereof.

CITATION LIST

Patent Document

[Patent Document 1]
Japanese Unexamined Patent Application Publication No. 2010-280022

SUMMARY OF INVENTION

Technical Problem

A cutting tool of which a cutting edge is manufactured from SKH59 has excellent cutting durability. In addition, a plastic working tool manufactured from SKH59 also has excellent durability. However, premature chipping may occur at the cutting edge of the cutting tool according to usage conditions, and also, premature chipping, cracking and breakage may occur on a shaped surface of the plastic working tool (that is, a surface formed by plastically processing the metal material).

In addition, with regard to the "material for tools" used for the above-described cutting tool and plastic working tool, there may be a case in which stretching to a predetermined size is difficult due to low ductility of the material (having poor hot workability) when hot working is performed on the above-described material such as the steel ingot or the steel piece in the manufacturing process.

An object of the present invention is to provide a high-speed tool steel having excellent hot workability and excellent damage resistance when made into various tools, a material for tools which is prepared using the same, and a method for producing the material for tools.

Solution to Problem

The present invention provides a high-speed tool steel which contains, in mass %, 0.9 to 1.2% of C, 0.1 to 1.0% of Si, 1.0% or less of Mn, 3.0 to 5.0% of Cr, 2.1 to 3.5% of W, 9.0 to 10.0% of Mo, 0.9 to 1.2% of V, 5.0 to 10.0% of Co, 0.020% or less of N, and the remainder being Fe and impurities, wherein an M value in a relationship between contents of C, Si, W, Mo, V and Co contained in the high-speed tool steel represented by the following formula satisfies $-1.5 \leq M$ value$\leq 1.5$. Formula: M value$=-9.500+9.334[\%\ C]-0.275[\%\ Si]-0.566[\%\ W]-0.404[\%\ Mo]+3.980[\%\ V]+0.166[\%\ Co]$, where characters in brackets [ ] indicate amounts (mass %) of each element contained.

Further, the present invention provides a material for tools which is formed of this high-speed tool steel and in which a maximum diameter of pieces of carbide contained in a cross-sectional structure, which is an estimated maximum predictive value $\sqrt{(Area_{max})}$ calculated by an extreme value statistical method is 32.0 μm or less.

Further, the present invention provides a method for producing a material for tools, in which a high-speed tool steel which contains, in mass %, 0.9 to 1.2% of C, 0.1 to 1.0% of Si, 1.0% or less of Mn, 3.0 to 5.0% of Cr, 2.1 to 3.5% of W, 9.0 to 10.0% of Mo, 0.9 to 1.2% of V, 5.0 to 10.0% of Co, 0.020% or less of N and the remainder being Fe and impurities is cast into a steel ingot, and hot working is performed on the steel ingot, wherein an M value which a relationship between contents of C, Si, W, Mo, V and Co contained in the high-speed tool steel represented by the following formula satisfies $-1.5 \leq M$ value$\leq 1.5$. Formula: M value$=-9.500+9.334[\%\ C]-0.275[\%\ Si]-0.566[\%$ W]−0.404[% Mo]+3.980[% V]+0.166[% Co], where characters in brackets [ ] indicate amounts (mass %) of each element contained.

Advantageous Effects of Invention

According to the present invention, it is possible to improve hot workability of a high-speed tool steel. Additionally, premature damage during use of tools can be minimized by using a material for tools, which is made of this high-speed tool steel, for cutting edges of various cutting tools or plastic working tools.

DESCRIPTION OF EMBODIMENTS

Figure 1:
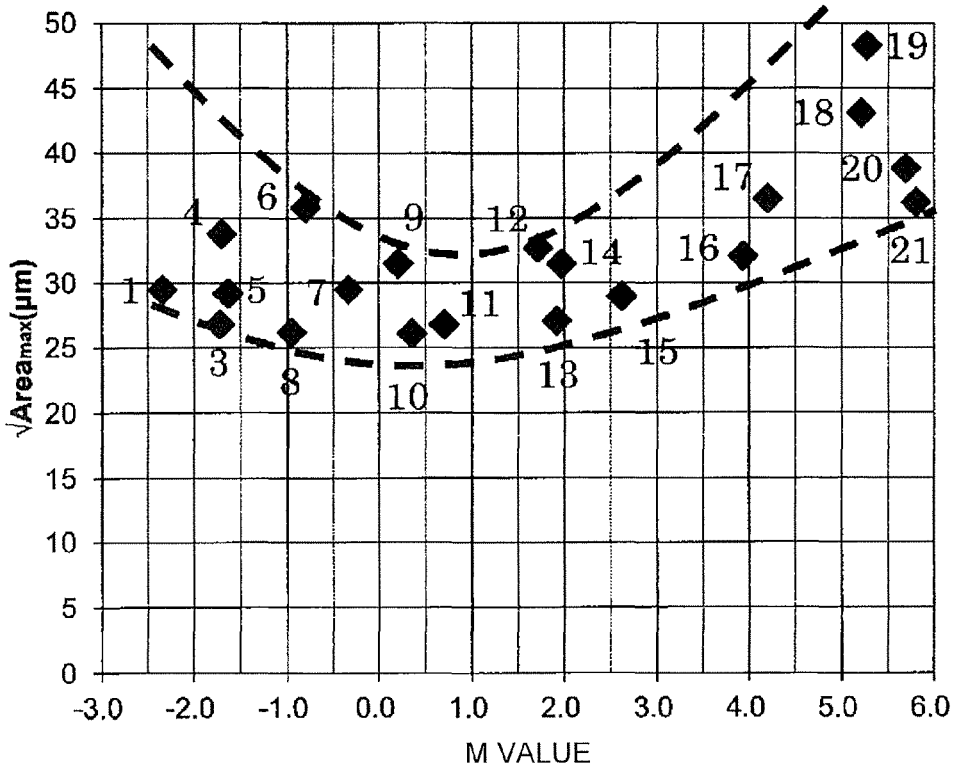
FIG. 1 is s a diagram illustrating a relationship between an M value and an estimated maximum predictive value $\sqrt{(Area_{max})}$ of pieces of carbide contained in a cross-sectional structure with respect to materials for tools obtained by forging steel ingots respectively made of high-speed tool steels according to examples of the present invention and comparative examples.

Coarse carbide which may be contained in a structure of a material for tools cause tool damage such as chipping and cracking on a cutting edge of a cutting tool during use or a shaped surface of a plastic working tool. That is, when a large amount of significantly coarse carbide is contained in a structure of a material for tools, these significantly coarse carbide may remain in a product structure after quenching and tempering, and toughness of a cutting edge or a shaped surface may be lowered. Additionally, a stress (fracture stress) required for breaking the cutting edge or the shaped surface in use then decreases, and damage occurs with the coarse carbide as a starting point. Therefore, reducing the size of the pieces of carbide in the structure of the material for tools is effective for minimizing the above-described tool damage.

In such a technical background, a component composition of SKH59 which can realize high hardness is an alloy design which forms a large amount of carbide in a structure. Additionally, in the case of a high-speed tool steel having such a component composition, massive eutectic carbide which is significantly coarsened in a cast structure is likely to be formed at the time of forming a material such as a steel ingot or a steel piece. Generally, $M_2C$ eutectic carbide (hereinafter, referred to as "eutectic $M_2C$") in the cast structure is in the form of plates and may be decomposed into granular $M_6C$ carbide (hereinafter, referred to as "decomposed $M_6C$") by hot working. However, when eutectic $M_2C$ is formed in a significantly coarse massive form, it may not be changed to decomposed $M_6C$, which is sufficiently granulated, even by subsequent hot working (wire processing) after a manufacturing process of the material for tools, and thus much significantly coarse carbide may be present in an annealed structure of the material for tools.

Further, $M_6C$ eutectic carbide (hereinafter, referred to as "eutectic $M_6C$") may also be formed in a cast structure of a high-speed tool steel having the same component composition as that of SKH59. Generally, this eutectic M6C has a fish bone shape. Additionally, it is difficult to granulate this by the hot working. Therefore, when eutectic $M_6C$ is significantly coarsened, after hot working, it remains "as it is" in a significantly coarsened state, and thus much significantly coarse carbide is present in an annealed structure of a material for tools.

Additionally, it is difficult to make the carbide which is not finely formed in an annealed structure of a material for tools fine even by quenching and tempering in a final process. As a result, although various tools containing a lot of coarse carbides in the structure of the cutting edge or the shaped surface may have excellent wear resistance, a lot of coarse carbides serve as a cause of lowering of damage resistance necessary for suppressing chipping, cracking, and so on.

Further, at the time of forming the material such as the steel ingot or the steel piece, when the remarkably coarse carbides formed in the cast structure are not changed into granules even by hot working, hot workability of this material is lowered and it is difficult to stretch the material to a predetermined size with the subsequent hot working.

Therefore, first of all, the present inventor reviewed the component composition of the "high-speed tool steel" itself as a basis for a material for tools. Additionally, a component composition which is advantageous for refining the eutectic carbide in the cast structure was found. Hereinafter, reasons for limiting the component composition of the high-speed tool steel of the present invention will be described below ("mass %" is simply referred to as "%").

C: 0.9 to 1.2%

C is an element which combines with Cr, W, Mo and V to form carbides, enhances quenching and tempering hardness and improves wear resistance. However, when too much is included, the hot workability deteriorates. Also, the toughness decreases. Therefore, after balancing with an amount of Cr, W, Mo and V which will be described later, 0.9 to 1.2%, preferably, 0.95% or more, and more preferably, 1.00% or more of C is set. Also, 1.15% or less or more preferably 1.10% or less is preferably set.

Si: 0.1 to 1.0%

Si is usually used as a deoxidizing agent in a dissolution process. Additionally, it is an element which improves cutting workability of the material for tools. However, when too much is included, coarse eutectic carbide is likely to be formed in a cast structure, and the hot workability deteriorates. Furthermore, the toughness decreases. Therefore, 0.1 to 1.0% of Si is set. Preferably, an amount is at least 0.2%. More preferably, it is 0.25% or more. Preferably, an amount is 0.6% or less. More preferably, 0.5% or less. Further preferably, 0.4% or less.

Mn: 1.0% or Less

Similar to Si, Mn is used as a deoxidizing agent. However, when too much is included, the toughness is lowered, and thus it is set to be 1.0% or less. Preferably, it is 0.6% or less. More preferably, it is 0.5% or less. Further preferably, it is 0.4% or less. In addition, when Mn is contained, preferably, there is 0.1% or more included. More preferably, it is 0.2% or more. Further preferably, it is 0.25% or more.

Cr: 3.0 to 5.0%

Cr is an element which is effective for imparting hardenability, wear resistance, oxidation resistance and so on. However, when too much is included, it readily promotes an increase in an amount of solid solution C in the cast structure, which serves as a factor of deteriorating the hot workability of the steel ingot. Furthennore, the toughness, high-temperature strength and temper softening resistance of a tool product are lowered. Therefore, it is set to be 3.0% to 5.0%. Preferably, it is 3.5% or more. More preferably, it is 3.6% or more. Further preferably, it is 3.7% or more. Particularly preferably, it is 3.8% or more. In addition, it is preferably 4.5% or less. More preferably, it is 4.3% or less. Further preferably, it is 4.1% or less. Particularly preferably, it is 4.0% or less.

W: 2.1 to 3.5%

W combines with the above-described C to form a special carbide and imparts wear resistance or seizure resistance. Further, a secondary hardening action during tempering is great, and the high temperature strength is also improved. However, when too much is included, the hot workability is lowered. Furthermore, it serves as a factor which coarsens the carbide. Therefore, it is set to be 2.1% to 3.5%. Preferably, it is 2.2% or more. More preferably, it is 2.3% or more. Further preferably, it is 2.4% or more. In addition, it is preferably 2.9% or less. More preferably, it is 2.8% or less. Further preferably, it is 2.7% or less. Particularly preferably, it is 2.6% or less.

Mo: 9.0 to 10.0%

Similar to W, Mo combines with C to form a special carbide and imparts wear resistance or seizure resistance. Furthermore, a secondary hardening action during tempering is large, and the high temperature strength is also improved. However, when too much is included, the hot workability is lowered. Therefore, it is set to be 9.0% to 10.0%. Preferably, it is 9.1% or more. More preferably, it is 9.2% or more. Further preferably, it is 9.3% or more. Particularly preferably, it is 9.4% or more. In addition, it is preferably 9.9% or less. More preferably, it is 9.8% or less. Further preferably, it is 9.7% or less. Particularly preferably, it is 9.6% or less.

V: 0.9 to 1.2%

V combines with C to form hard carbides and contributes to improvement of the wear resistance. However, when too much is included, the hot workability is lowered. Further, the toughness is lowered. Therefore, it is set to be 0.9% to 1.2%. Preferably, it is 0.93% or more. More preferably, it is 0.95% or more. In addition, it is preferably 1.15% or less. More preferably, it is 1.10% or less.

Co: 5.0 to 10.0%

Co forms a solid solution in a matrix, improves hardness of tempered martensite and contributes to the improvement of the wear resistance. Further, it improves strength and heat resistance of a tool. However, when too much is included, the hot workability is lowered. Furthermore, the toughness is lowered. Therefore, it is set to be 5.0% to 10.0%. Preferably, it is 6.0% or more. More preferably, it is 6.5% or more. Further preferably, it is 7.0% or more. In addition, it is preferably 9.3% or less. More preferably, it is 9.2% or less. Further preferably, it is 9.0% or less. Particularly preferably, it is 8.5% or less.

N: 0.020% or less

N has an effect of suppressing clumping of eutectic carbide in the cast structure of the high-speed tool steel having the above-described component composition. However, when too much is included, vanadium nitride is formed in the cast structure, and the hot workability of the material is lowered. Also, in contrast, this has an action of promoting clumping of eutectic carbide. Therefore, N is set to be 0.020% or less. Preferably, it is 0.019% or less. More preferably, it is 0.018% or less. Further preferably, it is 0.017% or less. In addition, when N is contained, to obtain the above-described effect, it is preferably 0.005% or more. More preferably, it is 0.008% or more. Further preferably, it is 0.012% or more. Particularly preferably, it is 0.015% or more.

Additionally, in the present invention, it is important to control an M value calculated using the following formula such that it is within a range of "−1.5 to 1.5" in the component composition of the high-speed tool steel.

Formula: M value=−9.500+9.334[% C]−0.275[% Si]−0.566[% W]−0.404[% Mo]+3.980[% V]+0.166[% Co]

where characters in brackets [ ] indicate contained amounts (mass %) of the respective elements.

The above formula gives an indicating value indicating an amount (frequency of occurrence) of eutectic carbide which can be "stably" present in the structure of a high-speed tool steel having the component composition of the present invention. Specifically, for eutectic $M_2C$, it shows the frequency of occurrence at which this can remain in the structure of the material for tools after hot working without being decomposed into $M_6C$ by the hot working when a material having eutectic carbide formed in the cast structure is thermally processed. Additionally, for eutectic $M_6C$, it shows frequency therefor (that is, frequency in the material for tools after hot working).

The above-described formula will be described. First, in the case of the high-speed tool steel of the present invention, C, Si, W, Mo, V and Co may be cited as elements which affect stabilization of the above-described eutectic carbide. Additionally, among these elements, the inventors have found that C, V and Co promote stabilization of eutectic $M_2C$ and Si, W and Mo promote stabilization of eutectic $M_6C$. Further, the inventors have realized the above-described formula which can evaluate a balance of frequencies of mutually changing eutectic $M_6C$ and eutectic $M_2C$ in the composition of high-speed tool steel by attaching "plus" coefficients to C, V and Co promoting stabilization of eutectic $M_2C$, attaching "minus" coefficients to Si, W and Mo promoting stabilization of eutectic $M_6C$ and determining a coefficient value (absolute value) for each of the coefficients according to an extent (frequency) of promotion of stabilization of eutectic carbide.

By such determination of the coefficients, making the M value according to the above formula closer to "zero" means that there is less eutectic carbide which is cause of coarsening of the carbide. That is, by making the M value closer to "zero", the eutectic $M_2C$ in the cast structure can be easily changed to finely decomposed $M_6C$ by hot working. Additionally, an amount of eutectic $M_6C$ which would initially have been difficult to make fine by hot working may be reduced.

Therefore, in the present invention, the M value is set to be "1.5 or less." Accordingly, the amount of stable eutectic $M_2C$ is reduced, and thus eutectic $M_2C$ may be changed into finely decomposed $M_6C$ by hot working. Preferably, it is "1.0 or less." More preferably, it is "0.8 or less." Further preferably, it is "0.7 or less." In addition, in the present invention, the M value is set to be "−1.5 or more." Therefore, the eutectic $M_6C$ itself which is difficult to be made fine by the hot working may be reduced. Preferably, it is "−1.0 or more." More preferably, it is "−0.8 or more." Further preferably, it is "−0.7 or more." It is possible to improve the hot workability of the high-speed tool steel and to improve the damage resistance of various tools by adjusting the M value to be within these ranges.

In addition, S and P may be contained as inevitable impurity elements in the high-speed tool steel of the present invention. When too much of S is included, it inhibits the hot workability of a material, and thus the amount thereof is preferably restricted to 0.010% or less. More preferably, it is 0.005% or less. Further preferably, it is 0.001% or less. When P is too much, the toughness deteriorates, and thus it is preferably restricted to 0.05% or less. More preferably, it is 0.03% or less. Further preferably, it is 0.025% or less.

Additionally, the material for tools which has a small size of carbide pieces in the annealed structure after the hot working can be obtained by casting the high-speed tool steel having the above-described component composition into a steel ingot and then performing the hot working with respect to the steel ingot. At this time, with respect to the carbide size, a maximum diameter of the pieces of carbide contained in a cross-sectional structure of the material for tools, which is an estimated maximum predictive value $\sqrt{(Area_{max})}$ calculated by an extreme value statistical method may be 32.0 μm or less. By setting the estimated maximum predictive value $\sqrt{(Area_{max})}$ according to the extreme value statistical method to 32.0 μm or less, it is possible to further improve the damage resistance of various tools. More preferably, it is 30.0 μm or less. Further preferably, it is 28.0 μm or less.

First Embodiment

Molten steel with a predetermined adjusted component composition was prepared. Additionally, steel ingots of high-speed tool steels having component compositions shown in Table 1 were manufactured by casting the molten steel at a cooling rate of about 10° C./min corresponding to an actual operation level. Furthermore, Steel Ingot No. 13 corresponds to SKH59. In Table 1, the steel ingots are arranged in order from the one having the smallest M value so that effects of the present invention can be easily evaluated.

Next, the above steel ingots Nos. 1 to 21 were forged by hot working to obtain Tool Materials Nos. 1 to 21 corresponding to the above numerical order of steel ingots in an annealed state and made as a rectangular bar material having a cross-sectional shape of 20 mm×20 mm. At this time, during forging, when forging into a cross-sectional shape from an end of the steel ingot, in a case in which a crack occurred on a surface of the bar material (or steel ingot) during the forging, a length (forged length) of the bar material was also then measured. Table 2 shows the forged length of each of the materials for tools after the hot working together with the M value thereof. The forged length is indicated as an index value according to the tool material No. 13 which is SKH59 being set to "100", such that the hot workability of the high-speed tool steels can be easily evaluated.

TABLE 2

| Steel ingot No | M value | Forged length | Remarks for reference |
|---|---|---|---|
| 1 | −2.34 | 61 | Comparative |
| 2 | −1.75 | Forging stopped | Examples |
| 3 | −1.72 | 87 | |
| 4 | −1.70 | 79 | |
| 5 | −1.63 | 83 | |
| 6 | −0.80 | 112 | |
| 7 | −0.33 | 81 | |
| 8 | −0.95 | 105 | Examples of |
| 9 | 0.21 | 131 | the present |
| 10 | 0.36 | 109 | invention |
| 11 | 0.70 | 125 | |
| 12 | 1.71 | 75 | Comparative |
| 13 | 1.92 | 100 | Examples |
| 14 | 1.97 | 93 | |
| 15 | 2.62 | 66 | |
| 16 | 3.93 | 91 | |
| 17 | 4.20 | 92 | |
| 18 | 5.21 | 94 | |
| 19 | 5.27 | 42 | |
| 20 | 5.69 | 104 | |
| 21 | 5.80 | 89 | |

In Table 2, in the tool materials Nos. 8 to 11 of the present invention in which the amount of each element contained in

TABLE 1

| Steel | Component composition (mass %) *The remainder is Fe and impurities | | | | | | | | | | | | Remarks for |
|---|---|---|---|---|---|---|---|---|---|---|---|---|---|
| ingot No. | C | Si | Mn | P | S | Cr | W | Mo | V | Co | N | M value | reference |
| 1 | 1.02 | 0.33 | 0.30 | 0.019 | 0.0005 | 3.97 | 6.12 | 7.17 | 0.83 | 4.97 | 0.0147 | −2.34 | Comparative |
| 2 | 1.02 | 0.50 | 0.30 | 0.019 | 0.0005 | 4.17 | 5.17 | 7.02 | 0.84 | 4.96 | 0.0150 | −1.75 | Examples |
| 3 | 1.03 | 0.31 | 0.31 | 0.019 | 0.0005 | 3.96 | 6.17 | 7.14 | 0.84 | 7.97 | 0.0144 | −1.72 | |
| 4 | 0.92 | 0.31 | 0.29 | 0.024 | 0.0026 | 3.89 | 2.18 | 9.98 | 0.92 | 5.48 | 0.0195 | −1.70 | |
| 5 | 0.92 | 0.31 | 0.29 | 0.022 | 0.0024 | 3.88 | 3.88 | 9.39 | 1.01 | 7.92 | 0.0181 | −1.63 | |
| 6 | 1.02 | 0.30 | 0.30 | 0.019 | 0.0005 | 3.94 | 3.92 | 8.01 | 0.99 | 4.94 | 0.0169 | −0.80 | |
| 7 | 1.02 | 0.32 | 0.30 | 0.019 | 0.0005 | 3.90 | 4.01 | 8.15 | 1.01 | 7.95 | 0.0147 | −0.33 | |
| 8 | 0.97 | 0.31 | 0.30 | 0.020 | 0.0025 | 3.86 | 2.13 | 9.45 | 0.94 | 5.48 | 0.0188 | −0.95 | Examples of |
| 9 | 1.07 | 0.31 | 0.30 | 0.018 | 0.0009 | 3.89 | 2.51 | 9.63 | 1.09 | 5.05 | 0.0158 | 0.21 | the present invention |
| 10 | 1.07 | 0.31 | 0.30 | 0.022 | 0.0028 | 3.88 | 2.63 | 9.61 | 1.00 | 8.03 | 0.0168 | 0.36 | |
| 11 | 1.07 | 0.31 | 0.30 | 0.018 | 0.0009 | 3.87 | 2.50 | 9.64 | 1.09 | 7.88 | 0.0152 | 0.70 | |
| 12 | 1.12 | 0.31 | 0.30 | 0.019 | 0.0028 | 3.91 | 2.31 | 9.43 | 1.13 | 8.83 | 0.0167 | 1.71 | Comparative |
| 13 | 1.08 | 0.31 | 0.30 | 0.019 | 0.0006 | 3.93 | 1.41 | 9.25 | 1.19 | 7.88 | 0.0136 | 1.92 | Examples |
| 14 | 1.13 | 0.32 | 0.31 | 0.020 | 0.0018 | 3.87 | 2.34 | 9.46 | 1.15 | 9.50 | 0.0161 | 1.97 | |
| 15 | 1.22 | 0.31 | 0.28 | 0.019 | 0.0005 | 4.05 | 7.04 | 7.62 | 1.61 | 7.97 | 0.0132 | 2.62 | |
| 16 | 1.20 | 0.52 | 0.52 | 0.019 | 0.0006 | 3.98 | 2.09 | 9.07 | 1.54 | 7.00 | 0.0157 | 3.93 | |
| 17 | 1.25 | 0.52 | 0.52 | 0.019 | 0.0006 | 3.95 | 2.08 | 9.00 | 1.56 | 4.94 | 0.0126 | 4.20 | |
| 18 | 1.30 | 0.51 | 0.51 | 0.019 | 0.0005 | 3.97 | 2.56 | 9.06 | 1.78 | 4.95 | 0.0151 | 5.21 | |
| 19 | 1.26 | 0.52 | 0.52 | 0.019 | 0.0005 | 3.95 | 2.44 | 9.01 | 1.75 | 7.98 | 0.0155 | 5.27 | |
| 20 | 1.24 | 0.32 | 0.32 | 0.019 | 0.0005 | 3.95 | 2.14 | 9.08 | 1.85 | 7.94 | 0.0182 | 5.69 | |
| 21 | 1.29 | 0.51 | 0.51 | 0.018 | 0.0004 | 3.95 | 2.13 | 9.07 | 1.81 | 4.96 | 0.0169 | 5.80 | |

M value = −9.500 + 9.334[% C] − 0.275[% Si] − 0.566[% W] − 0.404[% Mo] + 3.980[% V] + 0.166[% Co]

the high-speed tool steel satisfied the requirements of the present invention and the M value was adjusted such that it was within a range of "−1.5 to 1.5," the forged lengths exceeded "100", and among them, the forged length of the tool materials Nos. 9 and 11 were "120 or more," and substantially all of the steel ingots could be forged and stretched. Additionally, the hot workability was better than SKH59 (tool material No. 13).

In comparison, the forged lengths of the tool materials Nos. 1 to 5 in which the M values were smaller than "−1.5" were short due to a fact that a lot of coarse eutectic $M_6C$ was present in the cast structure of each of the steel ingots, regardless of a fact that a content of each element contained therein satisfied the present invention and hot workability was inferior to SKH59 (tool material No. 13). Among them, in the tool material No. 2, significant cracking occurred on the surface of the steel ingot from the beginning of forging due to a fact that the contents of S and Cr were high in addition to the above-described factors, and the hot working was stopped.

Further, in the tool materials Nos. 6 and 7 in which the M values were within the range of "−1.5 to 1.5," the tool material No. 6 had a higher content of W than the range of the present invention, but the forged length thereof exceeded 100. However, in the tool material No. 7, in addition to the higher content of W, the content of Mo was also higher, and thus the hot workability was deteriorated.

The tool materials Nos. 12 to 21 in which the M values were greater than "1.5" showed almost the same hot workability as that of SKH59 (tool material No. 13), except for some of them, regardless of the fact that the content of each element contained therein satisfied the present invention. Additionally, in regard to a part thereof, the tool material No. 15 had high contents of C, W and V, and thus the hot workability thereof was greatly deteriorated. Further, in the tool material No. 19, in addition to the high contents of C and V, the content of Co was also high, and thus the hot workability deteriorated greatly. In the tool material No. 21 having the high contents of C and V, the hot workability was deteriorated.

Figure 2:
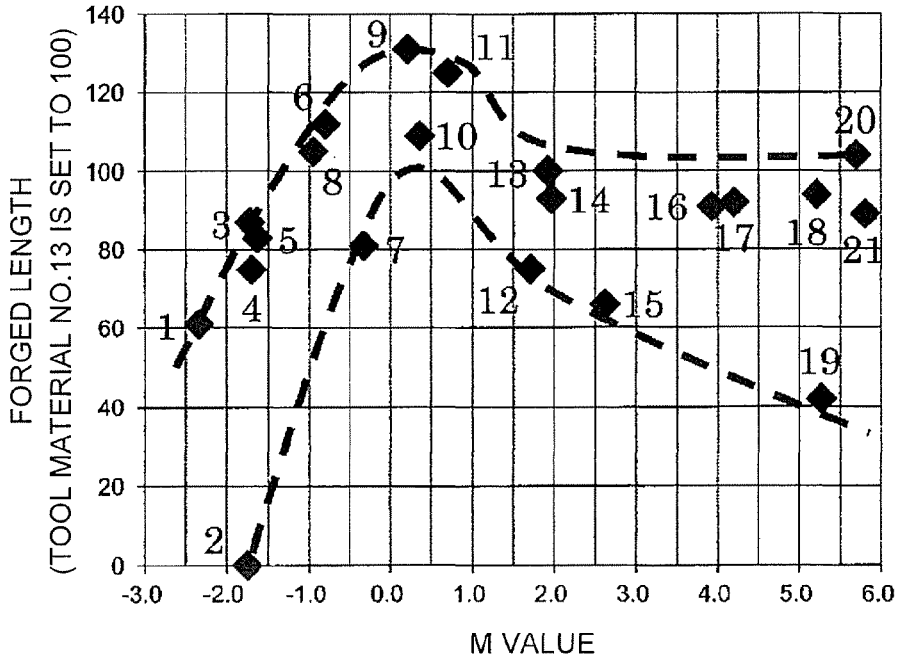
FIG. 2 is a diagram illustrating a relationship between an M value and a length after forging with respect to materials for tools obtained by forging steel ingots respectively made of high-speed tool steels according to the examples of the present invention and the comparative examples.

FIG. 2 illustrates a relationship between the M value and the forged length in the tool material Nos. 1 to 21 (however, for tool material No. 2 in which the hot working is stopped, the forged length is indicated as "0").

Next, a distribution of the carbides in the annealed structure of the tool material No. 1 to 21 was observed except for the tool material No. 2 in which the hot working was stopped. For this observation, a scanning electron microscope (SEM) with a magnification of 150 times was used. An observation surface was a cross section in a longitudinal direction (longitudinal cross section) including a center line of the bar material and was a rectangular area of 20 mm×20 mm which was defined by one side (20 mm) of a cross sectional shape of the bar material and one side (20 mm) in a lengthwise direction of the bar material. Additionally, when it was assumed that one visual field was defined as a visual field of 34,080 $\mu m^2$ included in the rectangular observation surface, 64 visual fields were observed with the SEM, and the number of pieces of carbide having a maximum diameter of 9 μm or more in each visual field was measured.

Figure 3:
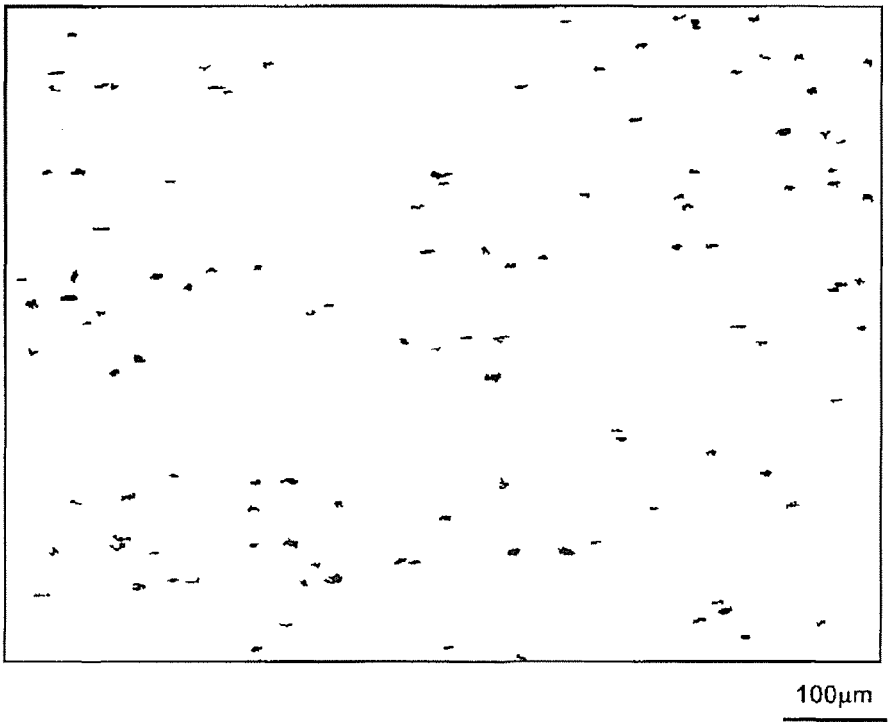
FIG. 3 is a binary-processed image of a cross section of a material for tools according to an example of the present invention observed with a scanning electron microscope and is a diagram illustrating pieces of carbide having a "maximum diameter of 9 μm or more" distributed in a cross section thereof.
Figure 4:
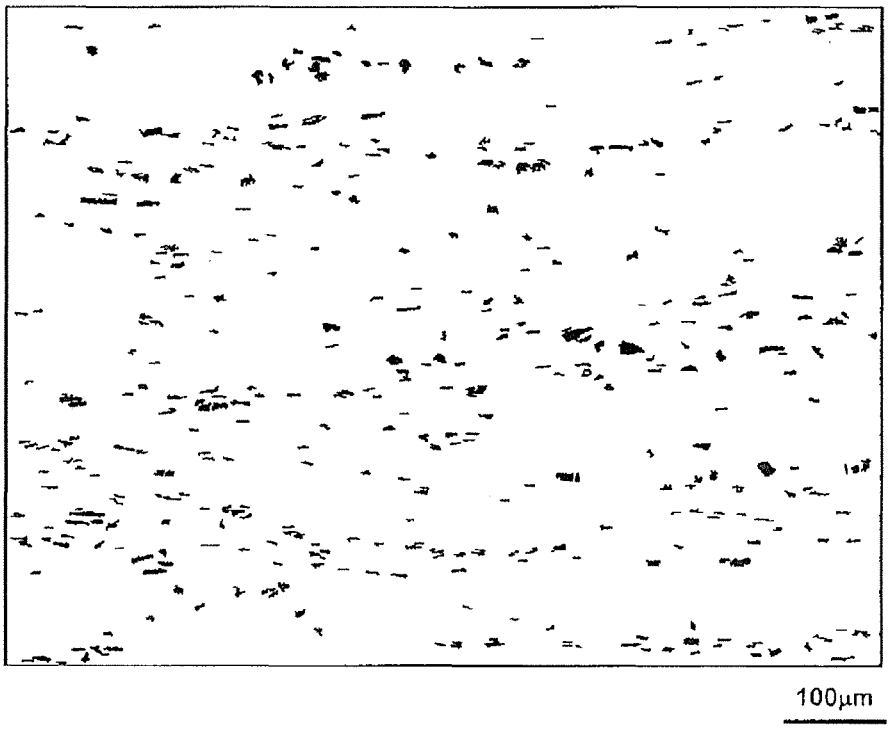
FIG. 4 is a binary-processed image of a cross section of a material for tools according to a comparative example observed with a scanning electron microscope and is a diagram illustrating pieces of carbide having a "maximum diameter of 9 μm or more" distributed in a cross section thereof.

The above-mentioned measurement of the carbides was carried out in the following manner. First, a binary image showing the carbides having a "maximum diameter of 9 μm or more" distributed on the observation surface was obtained by performing a binarization process on a reflected electron image obtained by SEM with a maximum diameter of "9 μm" as a threshold value on the basis of the maximum diameter of the carbide confirmed in the image. FIGS. 3 and 4 are binary images of the tool material No. 11 which is an example of the present invention and the tool material No. 19 which is a comparative example, respectively (the pieces of carbide are indicated by the distribution of dark spots). Additionally, the number of pieces of carbide with a maximum diameter of 9 μm or more was measured in the binary image.

Additionally, among the "carbides having the maximum diameter of 9 μm or more" obtained by the above-described measurement of the carbides, a size of "the largest carbide" was read for each visual field, and an extreme value statistical graph was created on the basis of the size of "the largest carbide" in each visual field and a frequency thereof. Additionally, the maximum diameter of the carbide contained in the cross-sectional structure of the material for tools (that is, the estimated maximum predictive value $\sqrt{(Area_{max})}$) was predicted by the extreme value statistical method. The estimated maximum predictive value was obtained by setting a recurrence period to 100 (described later) on the basis of the above extreme value statistical graph. Table 3 shows the maximum carbide diameter (estimated maximum predictive value $\sqrt{(Area_{max})}$).

For the above-described extreme value statistical processing, the spreadsheet software "Excel" from Microsoft Company was used. At this time, for the recurrence period necessary for the extreme value statistical processing, a predictive volume was set to 31.4 $mm^3$. This is based on a fact that, in a three-point bending test using a test piece with a diameter of 4 mm and a span of 50 mm which is usually used for evaluating the chipping resistance or the like of various tools, a risk portion which can be a starting point of destruction is in a portion of a volume within 5% of the diameter from a surface of the test piece towards a center thereof. Additionally, the maximum diameter of the carbide (estimated maximum predictive value $\sqrt{(Area_{max})}$) shown in Table 3 is an estimated value per 100 three-point bending test pieces described above.

TABLE 3

| Tool material No. | M value | $\sqrt{(Area_{max})}$ (μm) | Remarks for reference |
|---|---|---|---|
| 1 | −2.34 | 29.5 | Comparative |
| 2 | −1.75 | — | Examples |
| 3 | −1.72 | 26.8 | |
| 4 | 1.70 | 33.8 | |
| 5 | −1.63 | 29.2 | |
| 6 | −0.80 | 35.8 | |
| 7 | −0.33 | 29.5 | |
| 8 | −0.95 | 26.2 | Examples of |
| 9 | 0.21 | 31.5 | the present invention |
| 10 | 0.36 | 26.1 | |
| 11 | 0.70 | 26.8 | |
| 12 | 1.71 | 32.7 | Comparative |
| 13 | 1.92 | 27.1 | Examples |
| 14 | 1.97 | 31.5 | |
| 15 | 2.62 | 29.0 | |
| 16 | 3.93 | 32.1 | |
| 17 | 4.20 | 36.5 | |
| 18 | 5.21 | 43.1 | |
| 19 | 5.27 | 48.3 | |
| 20 | 5.69 | 38.8 | |
| 21 | 5.80 | 36.2 | |

In Table 3, the maximum diameters of the carbides contained in the cross-sectional structure of tool materials Nos. 8 to 11 according to the examples of the present invention are 32.0 μm or less which is the estimated maximum predictive value $\sqrt{(Area_{max})}$. In particular, $\sqrt{(Area_{max})}$ of each of the tool materials Nos. 8, 10 and 11 was 30.0 μm or less. Therefore, a tool manufactured using the material of tools according to the examples of the present invention can be expected to have improved damage resistance.

On the other hand, the estimated maximum predictive value $\sqrt{(Area_{max})}$ of each of the tool materials Nos. 1, 3, 5, 7, 14 and 15 was also 32.0 μm or less. However, these materials for tools were inferior to SKH59 (tool material No. 13) in the hot workability as described above.

The tool material No. 6 satisfied the range of "−1.5 to 1.5" of the present invention, but the content of W was higher than the range of the present invention, and the estimated maximum predictive value $\sqrt{(Area_{max})}$ exceeded 32.0 μm.

In the tool materials Nos. 12 and 16 to 21, the M value did not satisfy the range of "−1.5 to 1.5" of the present invention, and the estimated maximum predictive value $\sqrt{(Area_{max})}$ exceeded 32.0 μm.

FIG. 1 illustrates the relationship between the M value of the tool material Nos. 1 to 21 (excluding tool material No. 2) and the above $\sqrt{(Area_{max})}$.

In addition, the tool materials Nos. 1 to 21 (except for tool material No. 2) were quenched by heating to 1190° C. and then rapidly cooling, and then three times repeated tempering by holding for 1 hour at 560° C. was carried out. Additionally, the hardness of the tool material after the quenching and tempering was measured. The results are shown in Table 4. The tool materials Nos. 8 to 11 of the present invention achieved a sufficient hardness of 67.0 HRC or more, and among them, the tool materials Nos. 9 to 11 achieved high hardness of 68.0 HRC or more. From this fact, it is expected that a tool manufactured using the material for tools according to the example of the present invention would have a long life.

TABLE 4

| Tool material No. | Quenched and tempered hardness (HRC) | Remarks for reference |
|---|---|---|
| 1 | 68.5 | Comparative Examples |
| 2 | — | |
| 3 | 68.8 | |
| 4 | 67.3 | |
| 5 | 67.4 | |
| 6 | 68.4 | |
| 7 | 69.0 | |
| 8 | 67.9 | Examples of the present invention |
| 9 | 68.4 | |
| 10 | 69.1 | |
| 11 | 68.5 | |
| 12 | 68.9 | Comparative Examples |
| 13 | 68.4 | |
| 14 | 69.0 | |

TABLE 4-continued

| Tool material No. | Quenched and tempered hardness (HRC) | Remarks for reference |
|---|---|---|
| 15 | 69.1 | |
| 16 | 69.1 | |
| 17 | 68.9 | |
| 18 | 69.4 | |
| 19 | 69.3 | |
| 20 | 68.9 | |
| 21 | 68.8 | |

Second Embodiment

Molten steel adjusted to a predetermined component composition was prepared. Additionally, steel ingots Nos. 22 to 24 for high-speed tool steels having component compositions shown in Table 5 were manufactured by casting this molten steel at a cooling rate of about 10° C./min. Further, the steel ingot No. 24 corresponds to SKH59.

TABLE 5

| Steel ingot No. | Component composition (mass %) *The remainder is Fe and impurities | | | | | | | | | | | | Remarks for reference |
|---|---|---|---|---|---|---|---|---|---|---|---|---|---|
| | C | Si | Mn | P | S | Cr | W | Mo | V | Co | N | M value | |
| 22 | 1.05 | 0.33 | 0.30 | 0.018 | 0.0004 | 3.88 | 2.48 | 9.58 | 1.12 | 7.85 | 0.0120 | 0.70 | Examples of the present invention |
| 23 | 1.05 | 0.29 | 0.30 | 0.018 | 0.0009 | 3.91 | 2.52 | 9.61 | 0.96 | 7.88 | 0.0185 | 0.04 | |
| 24 | 1.09 | 0.31 | 0.29 | 0.019 | 0.0002 | 3.96 | 1.40 | 9.41 | 1.16 | 7.83 | 0.0160 | 1.91 | Comparative Examples |

M value = −9.500 + 9.334[% C] − 0.275[% Si] − 0.566[% W] − 0.404[% Mo] + 3.980[% V] + 0.166[% Co]

The steel ingot Nos. 22 to 24 were subjected to hot-working to obtain tool materials Nos. 22 to 24 corresponding to a numerical order of the above-described steel ingots formed of an annealed coil wire material having a diameter of 5 mm. Additionally, distribution of the carbides in the annealed structure of the tool materials Nos. 22 to 24 was observed. An observation surface was at a position of a center line of a longitudinal section including a center line of the coil wire. Additionally, assuming that one visual field is defined as a visual field of 34,080 $\mu m^2$ in the observation, the carbides having a maximum diameter of 9 μm or more in each visual field were measured for 64 visual fields in the same manner as in the first embodiment. Additionally, for the "carbide having the maximum diameter of 9 μm or more" obtained by the above measurement, the maximum diameter (estimated maximum predictive value $\sqrt{(Area_{max})}$) of the carbide contained in the cross-sectional structure of the tool material was predicted by the extreme value statistical method in the same manner as in the first embodiment. Additionally, the results are shown in Table 6.

TABLE 6

| Tool material No. | M value | $\sqrt{(Area_{max})}$ (μm) | Remarks for reference |
|---|---|---|---|
| 22 | 0.70 | 21.2 | Examples of the present invention |
| 23 | 0.04 | 21.8 | |
| 24 | 1.91 | 31.4 | Comparative Examples |

According to Table 6, in the tool materials Nos. 22 and 23 of the examples of the present invention, the maximum diameter of the carbides contained in the cross-sectional structure thereof was 32.0 μm or less which is the estimated maximum predictive value $\sqrt{(Area_{max})}$. Therefore, improvement in the damage resistance can be expected for a cutting tool or a plastic working tool produced using the material for tools according to the examples of the present invention.

For the tool materials Nos. 22 to 24, quenching from 1190° C. and three times repeated tempering for holding for 1 hour at 560° C. were carried out, assuming the quenching and the tempering under conditions to be performed on an actual tool. Additionally, a test piece after this quenching and tempering was subjected to a three-point bending test, and a maximum bending stress (that is, deflective strength) until the test piece broke was measured. In the bending test, a test piece size was 4 mm in diameter, 60 mm in length, and a span during testing was 50 mm. Further, the deflective strength was determined as an average value of the maximum bending stress by performing the above-described bending test four times. The results are shown in Table 7 together with quenched and tempered hardnesses.

TABLE 7

| Tool material No. | M value | Deflective strength (MPa) | Hardness (HRC) | Remarks for reference |
|---|---|---|---|---|
| 22 | 0.70 | 4165 | 68.6 | Examples of the present invention |
| 23 | 0.04 | 4126 | 69.0 | |
| 24 | 1.91 | 3687 | 68.8 | Comparative Examples |

The deflective strength is an indicator for evaluating the toughness of the tool, and as this value becomes larger, the toughness becomes higher. When the value of the deflective strength is high, it is possible to prevent premature chipping occurring in the cutting edge of the cutting tool. Further, in the plastic working tool, it is possible to suppress premature chipping, cracking, breaking, and so on occurring on the shaped surface. Additionally, as shown in Table 7, the tool materials Nos. 22 and 23 of the example of the present invention exhibited high deflective strength in a state of the tool product after quenching and tempering, as compared with the tool material No. 24 (SKH59) of the comparative example.

The invention claimed is:

1. A high-speed tool steel which contains, in mass %, 0.9 to 1.2% of C, 0.1 to 1.0% of Si, 1.0% or less of Mn, 3.0 to 5.0% of Cr, 2.1 to 3.5% of W, 9.0 to 10.0% of Mo, 0.9 to 1.2% of V, 5.0 to 10.0% of Co, 0.020% or less of N, and the remainder being Fe and impurities, wherein an M value in which a relationship between contents of C, Si, W, Mo, V and Co contained in the high-speed tool steel represented by the following formula satisfies $-1.0 \leq$ M value $\leq 1.0$;

formula: M value$=-9.500+9.334$[% C]$-0.275$[% Si]$-0.566$[% W]$-0.404$[% Mo]$+3.980$[% V]$+0.166$[% Co], where characters in brackets [ ] indicate amounts in mass % of each element contained.

2. A material for tools, which is formed of the high-speed tool steel according to claim 1, wherein a maximum diameter of carbide contained in a cross-sectional structure, which is an estimated maximum predictive value $\sqrt{(Area_{max})}$ calculated by an extreme value statistical method is 32.0 μm or less.

3. The high-speed tool steel according to claim 1, wherein the M value satisfies $-0.8 \leq$ M value $\leq 0.8$.

4. A method for producing a material for tools, in which a high-speed tool steel which contains, in mass %, 0.9 to 1.2% of C, 0.1 to 1.0% of Si, 1.0% or less of Mn, 3.0 to 5.0% of Cr, 2.1 to 3.5% of W, 9.0 to 10.0% of Mo, 0.9 to 1.2% of V, 5.0 to 10.0% of Co, 0.020% or less of N and the remainder being Fe and impurities, is cast into a steel ingot, and hot working is performed on the steel ingot, wherein an M value in which a relationship between contents of C, Si, W, Mo, V and Co contained in the high-speed tool steel represented by the following formula satisfies $-1.0 \leq$ M value $\leq 1.0$;

formula: M value$=-9.500+9.334$[% C]$-0.275$[% Si]$-0.566$[% W]$-0.404$[% Mo]$+3.980$[% V]$+0.166$[% Co], where characters in brackets [ ] indicate amounts in mass % of each element contained.

5. The method according to claim 4, wherein the M value satisfies $-0.8 \leq$ M value $\leq 0.8$.

* * * * *